US005197385A

United States Patent [19]

Burger

[11] Patent Number: 5,197,385

[45] Date of Patent: Mar. 30, 1993

[54] MODULAR, SELECTIVELY EXPANDABLE MULTI-COLOR PRINTING SYSTEM

[75] Inventor: Rainer Burger, Augsburg, Fed. Rep. of Germany

[73] Assignee: Man Roland Druckmaschinen AG, Offenbach am Main, Fed. Rep. of Germany

[21] Appl. No.: 867,158

[22] Filed: Apr. 10, 1992

[30] Foreign Application Priority Data

May 18, 1991 [DE] Fed. Rep. of Germany ..... 4116415

[51] Int. Cl.[5] ..... B41F 5/22; B41F 5/08

[52] U.S. Cl. ..... 101/177; 101/180

[58] Field of Search ..... 101/177, 181, 182, 179, 101/220

[56] References Cited

FOREIGN PATENT DOCUMENTS 23039 1/1981 European Pat. Off. ..... 101/177
0400444 12/1990 European Pat. Off. .
137829 7/1978 Fed. Rep. of Germany .
3220542 12/1983 Fed. Rep. of Germany .
3918127 12/1990 Fed. Rep. of Germany .

*Primary Examiner*—J. Reed Fisher
*Attorney, Agent, or Firm*—Frishauf, Holtz, Goodman & Woodward

[57] ABSTRACT

To expand a U printing system having two plate-blanket printing couples first to form a Y system for 2/1 (or 1/2) printing and then, further, to a dual-U system for 2/2 printing, with minimum space requirement, the axes of rotation of the base blanket cylinders are spaced from a separating line (3) between two superposed, staggered printing systems by different distances. An expansion group having two expansion plate-cylinder blanket couples likewise has the axes of rotation of the expansion blanket cylinders at different spacing from the separating line. Thus, by merely shifting a vertically arranged single blanket cylinder, previously in engagement with a lower blanket cylinder to release engagement therewith and engage against an opposite, newly arranged blanket cylinder, a space-saving 2/2 printing station is obtained.

6 Claims, 7 Drawing Sheets

MODULAR, SELECTIVELY EXPANDABLE MULTI-COLOR PRINTING SYSTEM

FIELD OF THE INVENTION

The present invention relates to printing machinery, and more particularly to a printing system for multicolor printing, especially offset printing. The present invention is particularly suitable for newspaper printing, and for job printing, for example advertising flyer printing or the like.

BACKGROUND

It is known to provide a basic printing system having two printing stations with blanket-to-blanket construction, and to combine with such a basic system an expansion or auxiliary system. The basic and the auxiliary system each can include printing stations which can be combined with each other, or severed along a predetermined severing line. Usually, the expansion system is located above the basic printing system or printing station.

Modular printing systems, particularly for newspaper printing of intermediate to large numbers of editions, are known which are constructed generally in a bridge-type arrangement, also known as a U shape arrangement, and which include a blanket-to-blanket station. The U printing system has two printing stations which each include a damper and an inker in engagement with a plate cylinder. The plate cylinder, in turn, is in engagement with a blanket cylinder. The two printing stations are so associated with respect to each other that a paper web on which the printing is to be done is interposed between the two blanket cylinders, so that the blanket cylinders, mutually, form impression cylinders.

By modullar retrofitting, an additional printing station can expand the U-shaped basic printing system to form a Y system which permits 2/1 or, respectively, 1/2 printing, that is, two printing subject matters on the prime side and one on the verso side, or the reverse thereof. A combination of such U printing systems and Y printing systems permits expansion of the overall printing press. For example, by placing two U basic systems next to each other or above each other, it is possible to obtain dual perfecting printing, that is, 2/2 printing. This arrangement has the advantage that only standard printing stations or components, which are frequently already available, are needed to form the overall system. There is a disadvantage, however, in that a serial placement of U printing systems for 2/2 printing is spaceconsuming, and it is not possible to retrofit a Y printing station for 2/2 printing without substantial modification and expense. Thus, flexibility for later expansion of a basic system is limited in such an arrangement.

German Patent Disclosure Document DE-OS 32 20 542 illustrates a printing system of the type to which the present invention relates in which an auxiliary or expansion system is formed of two further printing stations, one of which is associated directly with one of the blanket cylinders of the basic station, and two printing stations of the second unit have a central impression cylinder associated therewith. The basic station can, initially, be formed by a Y printing system and, after amplification by the expansion system, can be expanded to permit 4/1 printing. This arrangement has the advantage of a modular construction. The possibility of expanding the Y printing station, for 2/2 perfecting printing, however, is not provided.

THE INVENTION

It is an object to provide a printing system which is compact and can be inexpensively expanded, and which makes it possible, starting from a basic printing system, to expand the system, as required, for 2/1 printing, or 1/2 printing, respectively, in form of a Y printing system and, if necessary, to further retrofit the Y system for dual verso printing, that is, in a simple manner, to expand a printing system having three printing stations to a system having four printing stations; and, additionally, to illustrate examples of further expansion to multiple printing station printing presses.

Briefly, a base printing group has two plate cylinder-blanket cylinder printing couples in which the blanket cylinders of the printing couples are in engagement with a substrate web therebetween to define prime and verso printing lines. An expansion printing group, which, selectively, has one or two expansion plate cylinders and associated expansion blanket cylinders, to form expansion couples, is positioned if desired for expansion to be locatable above the base printing group. The expansion printing group and the base printing group are assembled above an essentially horizontal separating line.

In accordance with a feature of the invention, the axes of rotation of the base blanket cylinders are spaced from the separating line by different distances; the axis of rotation of one of the expansion blanket cylinders can be selectively positioned:

(a) to place that one expansion blanket cylinder in blanket-to-blanket printing engagement, with the substrate web therebetween, with one of the blanket cylinders of the first group, or (b) when the expansion group has two expansion plate cylinder-blanket couples, to place the surfaces of both expansion blanket cylinders in blanket-to-blanket printing engagement with the web therebetween. The axis of rotation of the second expansion blanket cylinder has a greater spacing from the separating line than the axis of rotation of the first expansion blanket cylinder. This axial spacing permits, upon positioning of the expansion group above the base group, a printing arrangement which selectively provides for a single prime and verso printing line between the base blanket cylinder and the expansion blanket cylinder or, if the expansion group has two printing couples, lateral shifting of the expansion group along the separating line places the circumferences of the expansion blanket cylinders out of engagement with the circumferences of the base blanket cylinders while placing the circumferences of the expansion blanket cylinders in engagement with each other, of course always with a substrate web W therebetween, to provide for additional prime and verso printing lines.

DRAWINGS

The attached drawings are highly schematic and only show those features which are necessary for an understanding of the invention, while omitting all non-essential features. In the drawings.

DETAILED DESCRIPTION

Figure 1:
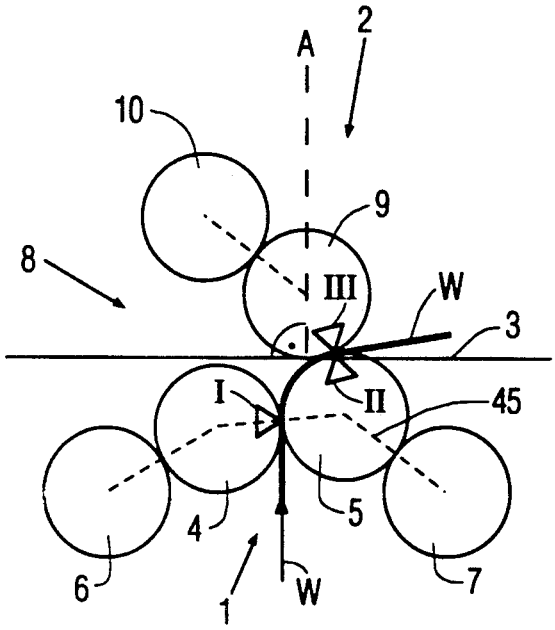
FIG. 1 illustrates the basic configuration of printing cylinders in a U printing system, expanded by an additional printing station to provide for 2/1, or 1/2 printing, respectively.

FIG. 1 shows, highly schematically, a printing system which has a basic printing station 1 and an expansion station 2. The two stations 1, 2 are assembled together, joined along a separating plane 3. Station 2 can be separated from station 1 along this plane 3. When combined, the stations are bolted or otherwise attached together, to be removable if desired.

The basic station 2 is formed of two printing arrangements, as well known, having engaged blanket cylinders 4, 5 with a web W therebetween. Plate cylinders 6, 7 are associated with respective blanket cylinders. Inkers and dampers are associated with the plate cylinders, not shown in the drawing, since they can be associated with the plate cylinders in any well-known customary manner.

In accordance with a feature of the invention, the blanket cylinders 4, 5 are so located in the base printing station 1 that their axes have a different spacing from the separating plane 3. A broken line 45 illustrates the centers of the axes, and their relative connection of the cylinders 4, 5, 6 and 7. As can be seen, the broken line 45 has a portion which is inclined with respect to the separating plane 3. The expansion station 2 has a printing unit 8 in a position A which is a single line printing station. The expansion station 2 has a blanket cylinder 9, engaged, with the web W therebetween, against the blanket cylinder 5, and a plate cylinder 10. Again, dampers and inkers have been omitted from the station 2, for simplicity of illustration. The engagement or printing line of the blanket cylinder 9 against the blanket cylinder 5 is shown at III in FIG. 1, I and II illustrate the printing lines of the blanket cylinders 4, 5, each applying, respectively, a printed image on the web W. This arrangement provides for 1/2 or 2/1 printing, that is, two impressions on one side of the web W and one impression on the reverse side thereof.

Figure 2:
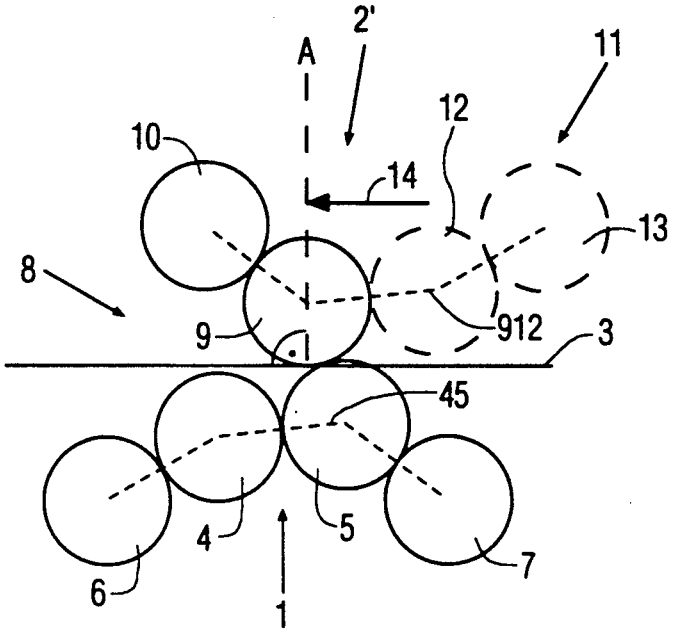
FIG. 2 illustrates, schematically, an assembly step of retrofitting the Y expansion printing station.

In accordance with a feature of the invention, as shown in FIG. 2, the expansion station 2' has an additional blanket cylinder 12 and an associated plate cylinder 13, forming a further printing unit 11. Upon shifting the position of the printing units 8 and 11 from the position A to the position B, see FIG. 3, in the direction of the arrow 14 (FIG. 2), a new printing configuration will result. Installation of the printing unit 11 and shifting from the position A to the position B can be done in a single assembly or rearrangement step.

The units 8, 11 of the expansion system 2, as well as the basic system 1, are modular so that the cylinders 4, 5, 6, 7 as well as 9, 10, 12 and 13 can be pre-installed in insertion positions in the side walls of the respective printing machines, each having their own individual drives, or coupled drives, together with the respective inkers and dampers. The arrangement can readily be so made that, after assembly and retrofitting, the drive for the printing unit 8 is retained.

Figure 3:
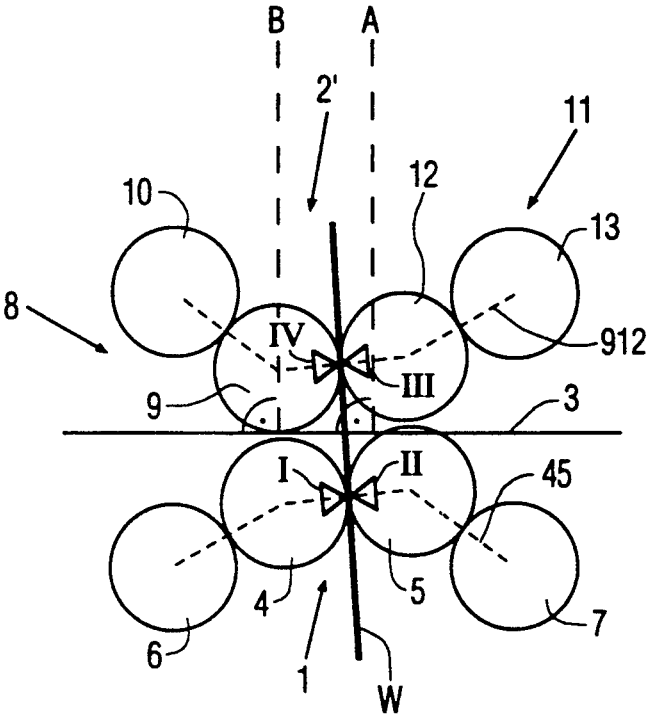
FIG. 3 illustrates the final assembly step and the cylinder arrangement to provide for 2/2 printing.

FIG. 3 illustrates the position of the blanket cylinders 4, 5 and 9, 12 in the base station 1 and the expansion station 2' after retrofitting. The positions of the blanket cylinders 9, 12 of the expansion system 2 are so arranged that the axis of the blanket cylinder 12 of the expansion unit 11 has a greater distance with respect to the separating plane 3 than the axis of the blanket cylinder 9 of the first expansion unit 8 of the expansion system 2. Thus, a line connecting the centers of the cylinders 10, 9, 12, 13, shown at 912 in FIG. 3, likewise will have a portion between the blanket cylinders 9, 12 which is inclined with respect to the separating plane 3.

The blanket cylinders 9, 12 in the expansion station 2' print in blanket-to-blanket relationship, with the web W therebetween, and the respective blanket cylinders of the expansion station 2' are now all spaced from the blanket cylinders 4, 5 of the base station 1. This cylinder configuration permits a vertical paper path for the web W between the blanket cylinders 4, 5 of the base station 1 as well as between the blanket cylinders 9, 12 of the expansion station 2. The necessary spacing of the blanket cylinders 9, 12 from the blanket cylinders 4, 5 eliminates and avoids engagement with respect to the blanket cylinders 4, 5 of the base station 1. The arrangement, in accordance with the invention, of the blanket cylinders 4, 5 and 9, 12, as described in connection with FIGS. 1-3, in simple manner, permits modular expansion of a Y type printing assembly capable only of 2/1 (or 1/2) printing to provide for 2/2 printing by retrofitting the overall arrangement.

Of course, the cylinder arrangement may be mirror-symmetrical or reversed sideways, if desired.

As can be seen from FIGS. 1-3, the diameters of the base blanket cylinders 4, 5 and of the expansion blanket cylinders 9, 11 are the same, and preferably all the same.

In accordance with a feature of the invention, thus, a modular system is provided in which the base station 1 forms the basic unit, to which an expansion station 2 can be added having a first modular unit 8 which expands the basic station 1 to a Y printing system and a further expansion unit 11 which then changes the prior Y printing system to a 2/2 overall printing press, without substantially increasing the space requirements of the overall system.

FIGS. 4-7 illustrate various combinations of basic systems, Y systems and 2/2 systems in accordance with the present invention, and various possibilities of cascading printing stations to form custom-arranged solutions for multicolor printing, with minimum investment costs.

Figure 4:
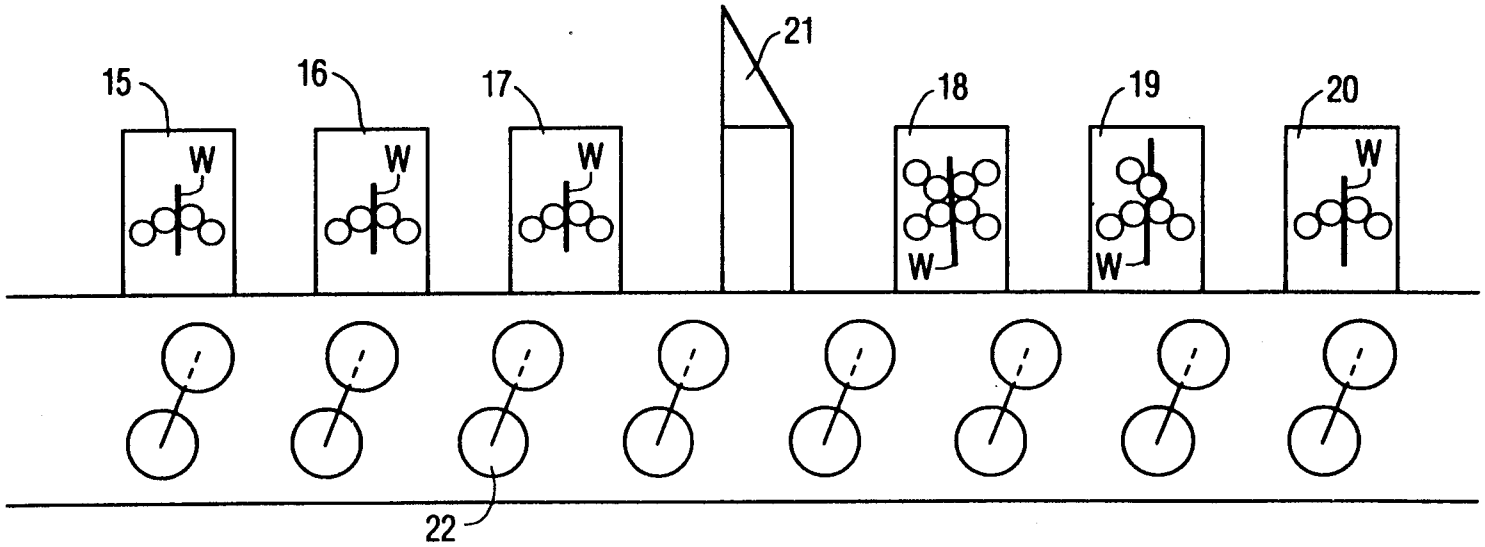
FIG. 4 is a highly schematic representation of printing cylinder arrangements of an expanded printing press.

FIG. 4, for example, shows a basic system having six printing stations 15, 16, 17, 18, 19, 20. The folder 21 is located between the printing stations 17 and 18. Paper supply rolls 22, of which only one is identified, are located beneath the printing stations 15-20. The printing stations 15, 16, 17 and 20 are basic stations and left as such; printing station 19 is expanded to a Y printing station, and station 18 is further expanded from the Y station to a 2/2 printing station 2', as illustrated in FIG. 3.

Figure 5:
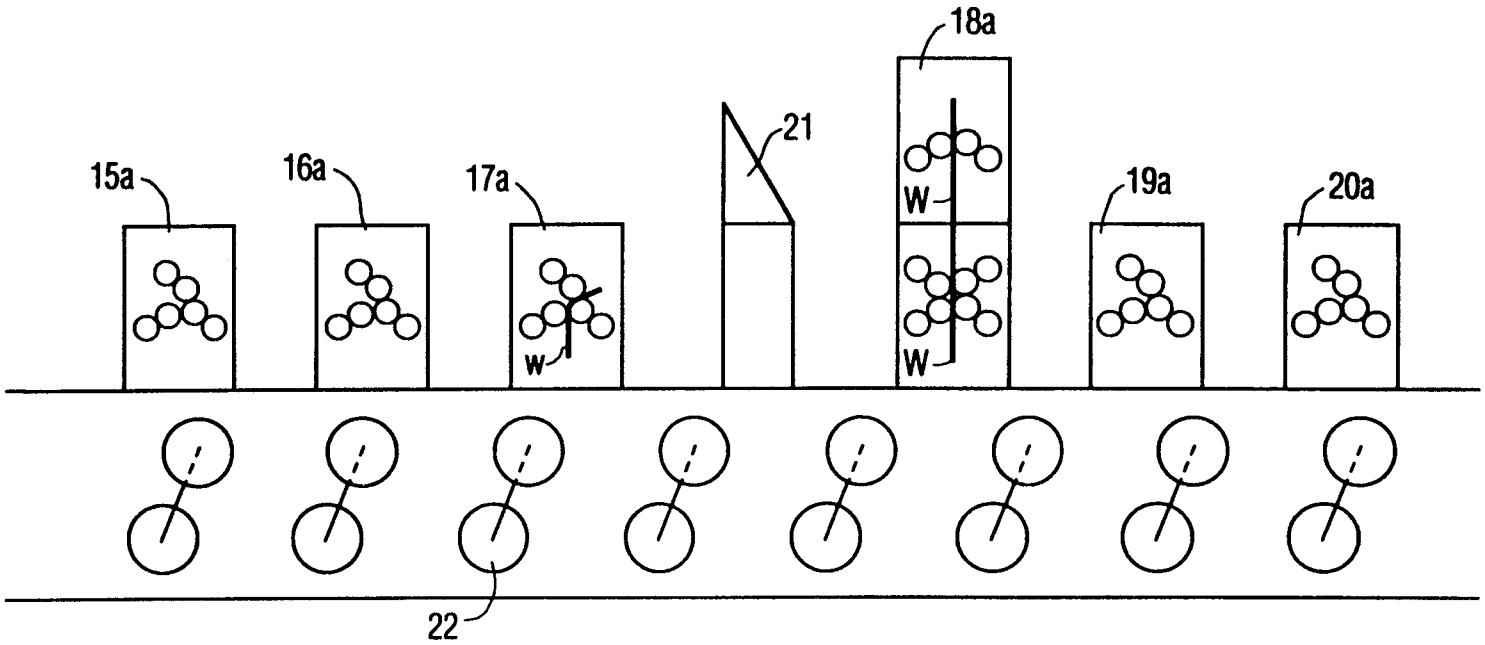
FIGS. 5, 6 and 7 are schematic representations of cylinder arrangements similar to the basic printing press of FIG. 4, in which the various printing stations are additionally expanded for multi-color printing.
Figure 6:
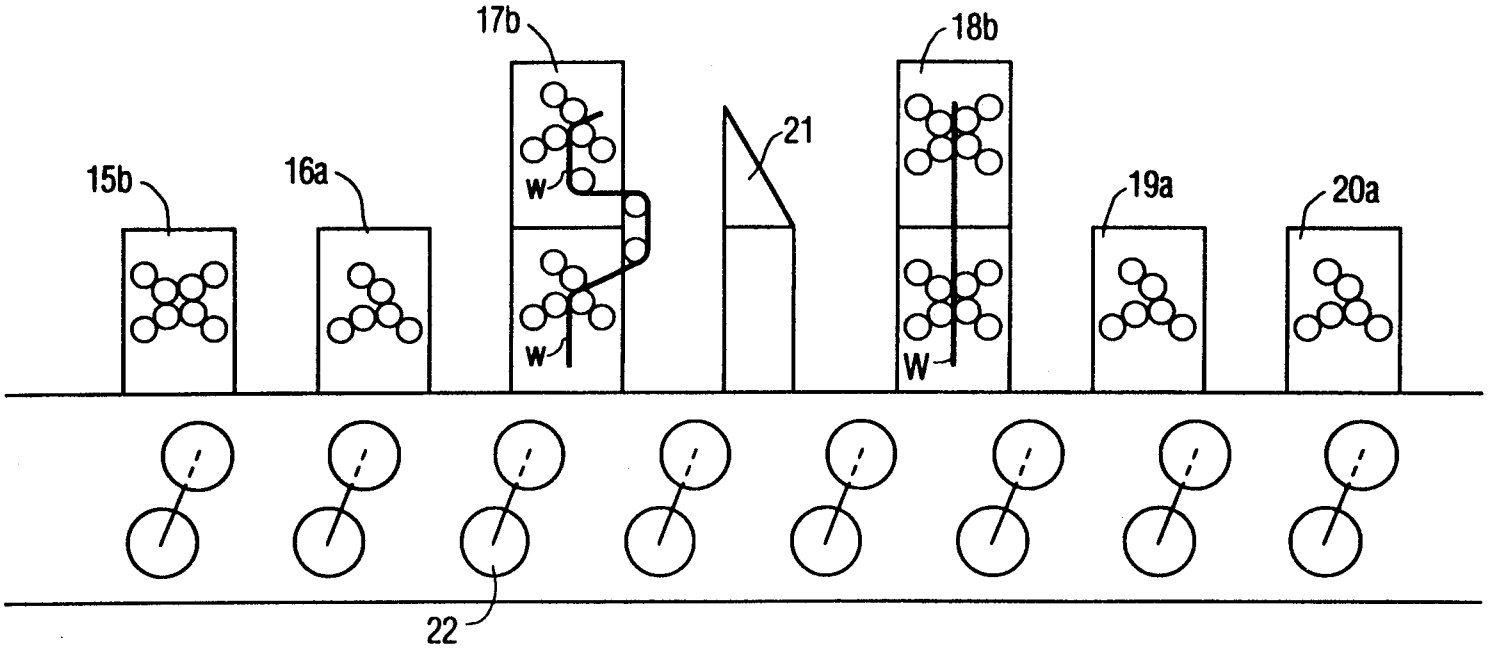
Figure 7:
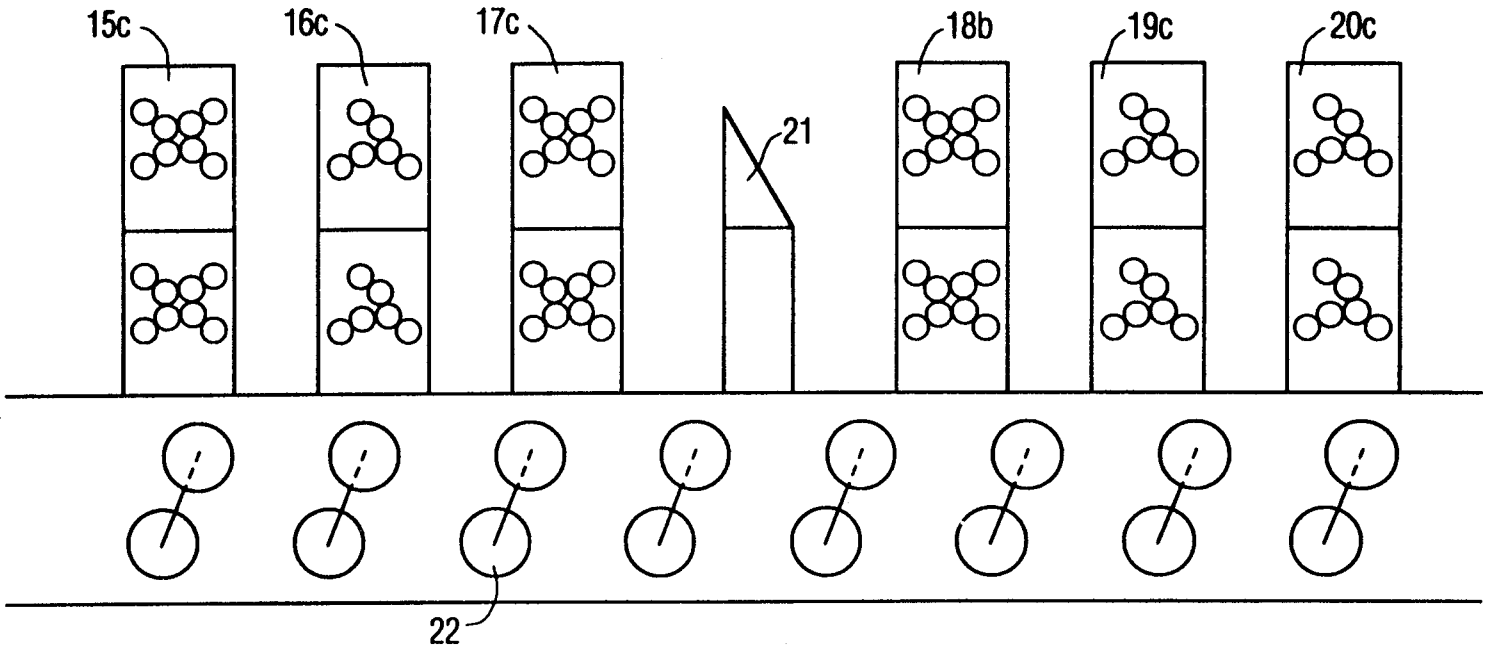

A further expansion of the overall system of FIG. 4 is shown in FIG. 5 in which printing stations 15*a* to 20*a* are shown, changed from the base stations 15-20, as illustrated. The path of the web W is shown only schematically. The printing station 18*a* has, at the bottom, a configuration similar to FIG. 3, whereas, cascaded on top, is a printing station 1 as shown in FIG. 1, for example. FIG. 6 illustrates a further expansion of the system of FIG. 5 in which the units 17*b* and 18*b* are changed from the units 17*a*, 18*a*, and the first unit 15*a* is expanded to be a 2/2 station, as described in connection with FIG. 3. Possible web paths are shown in the drawing at W; of course, other web paths are equally possible, the web then being guided over suitable web control and/or deflection rollers, as well known in the printing industry. FIG. 7 illustrates another further expansion with modified arrangements 15*c*, 16, 17*c*, 19*c* and 20*c*. Each one of these expansion possibilities, which are only illustrative, can be easily constructed and the expansion of any one of the printing stations can be carried out inexpensively, when needed. The superposed units, such as units 18*a*, or 15*c*, for example, as also sometimes referred to as printing towers.

Various changes and modifications may be made within the scope of the inventive concept.

I claim:

1. Modular, selectively expandable multi-color printing system, for printing, selectively, in (a) double prime and verso mode or (b) double prime, double verso mode, comprising a base printing group (1) including two base plate cylinder-blanket cylinder printing couples (6, 4; 7, 5), and an expansion printing group (2) having, selectively, (a) a first expansion printing couple (8) for printing in mode (a) and (b) for printing in mode (b), said first expansion printing couple (8) and a second expansion printing couple (11), wherein said first expansion printing couple includes a first expansion plate cylinder (10) and a first expansion blanket cylinder (9) and said second expansion printing couple (11) includes a second expansion plate cylinder (13) and a second expansion blanket cylinder (12);

said expansion printing group (2) being positioned above the base printing group (1) and separable therefrom along an essentially horizontal separating plane (3), wherein the base blanket cylinders (4, 5) are so positioned that the axes of rotation of the base blanket cylinders of the base group (1) are spaced from the separating line (3) by different distances;

the expansion printing group (2) is devoid of impression cylinders;

means for selectively printing in mode (a) wherein the axis of rotation of the first expansion blanket cylinder (9) of the first expansion printing couple (8) is positionable to place said first expansion blanket cylinder (9) in blanket-to-blanket printing engagement with the substrate web (W) therebetween for blanket-to-blanket printing with that one (5) of the base blanket cylinders of the first group (1) which has its axis of rotation at a smaller distance to said separating plane (3);

the circumference of said first expansion blanket cylinder (9) is placed above that one base blanket cylinder (5) to form printing lines for prime and verso printing between said base blanket cylinder (5) and said expansion blanket cylinder (9);

wherein the base blanket cylinders (4, 5) of the base printing couples are in engagement with a substrate web (W) therebetween, and define at least one printing line; and means for selectively printing in mode (b) wherein the surfaces of the expansion blanket cylinder (9, 12) of the first and second expansion printing couples are placed in blanket-to-blanket printing engagement, with the substrate web (W) therebetween, wherein the axis of rotation of the second expansion blanket cylinder (12) is spaced by a larger distance from said separating plane (3) than the distance of the axis of rotation of the first expansion blanket cylinder (9) from said separating plane (3), the first expansion blanket cylinder (9) of the first expansion printing couple (8) is is placed above that one (4) of the base blanket cylinders (4, 5) of the base printing group (1) which has the larger distance from said separating plane (3), and is circumferentially spaced and is out of engagement with the base blanket cylinder (5) of the base printing group (1) having the smaller distance to said separating plane (3);

said first and second base blanket cylinders (4, 5) of the base printing group (1) are in prime and verso printing engagement, with the web (W) therebetween, and defining prime and verso printing lines therebetween; and wherein the circumferences of the first and second expansion blanket cylinders (9, 12) are in printing engagement with the substrate web (W) therebetween to define additional prime and verso printing lines.

2. The system of claim 1, wherein, for printing in mode (a), said substrate web is guided between the base blanket cylinders (4, 5), and further between the first expansion blanket cylinder (9) and that one (5) of the base blanket cylinders (4, 5) which is closest to said separating plane (3) to provide for said double prime and single verso mode printing.

3. The system of claim 1, wherein said first (1) and second (2) printing groups are stacked above each other; and the substrate web (W) is passed between said prime and verso printing lines formed by the base blanket cylinder pairs (4, 5) of the base printing system and between the additional printing lines of the expansion blanket cylinder pairs (9, 12) to provide for said double prime, double verso mode printing.

4. The system of claim 1, wherein the difference in distance from the separating plane (3) of the blanket cylinders (4, 5; 9, 12) of the two groups are essentially the same.

5. The system of claim 1, wherein the diameters of the base blanket cylinders (4, 5) are the same.

6. The system of claim 1, wherein the diameters of the expansion blanket cylinders (9, 12) are the same.

* * * * *